US005238228A

United States Patent [19]

Moon

[11] Patent Number: 5,238,228

[45] Date of Patent: Aug. 24, 1993

[54] IMPACT ABSORBING BARRIER AND METHOD OF CONSTRUCTING SAME

[76] Inventor: Danial G. Moon, 509 E. Maple St., Fremont, Mich. 49412

[21] Appl. No.: 735,933

[22] Filed: Jul. 25, 1991

[51] Int. Cl.[5] ..... E01F 15/00

[52] U.S. Cl. ..... 256/13.1; 256/1

[58] Field of Search ..... 256/13.1, 12.5, 1

[56] References Cited

U.S. PATENT DOCUMENTS

| | | | |
|---|---|---|---|
| 3,692,281 | 9/1972 | Clayton | 256/1 X |
| 3,848,853 | 11/1974 | Way et al. | 256/13.1 X |
| 3,856,268 | 12/1974 | Fitch | 256/1 X |
| 3,951,384 | 4/1976 | Hildreth, Jr. | 256/1 |
| 4,030,706 | 6/1977 | Ward | 256/1 |
| 4,066,244 | 1/1978 | Yoho | 256/1 |
| 4,186,913 | 2/1980 | Bruner et al. | 256/1 X |

FOREIGN PATENT DOCUMENTS

| | | | |
|---|---|---|---|
| 2609222 | 1/1977 | Fed. Rep. of Germany | 256/13.1 |
| 1368772 | 10/1974 | United Kingdom | 256/13.1 |

*Primary Examiner*—Randolph A. Reese
*Assistant Examiner*—Christopher J. Novosad
*Attorney, Agent, or Firm*—Brooks & Kushman

[57] ABSTRACT

An impact absorbing barrier (10) for use in conjunction with moving vehicles or the like and a method of constructing includes a plurality of torroid-like bumpers (12) stacked vertically to form a cylinder (14). The bumpers (12) of the cylinder (14) are permanently bound together by bands (16) to form the barrier (10). At least one coupling (20) is attached to one of the bands (16) to allow multiple barriers (10) to be attached in a chain-like manner to form a guardrail. The method of constructing the impact absorbing barrier 10 includes the steps of separating a plurality of tires into tire halves (24), (26), (28); placing a first tire half (26) on a base with its concave side exposed; nesting a plurality of tire halves (24) on the exposed concave side of the first tire half (26); and placing a second tire half (28) with its concave side facing the nested tire halves (24) to envelope the nested tire halves (24) within the concave sides of the first tire half (26) and second tire half (28) to form a torroid-like bumper (12). These steps are repeated to form a bumper (12). The bumpers (12) are vertically stacked to form a cylinder (14), and cylinders (14) are tied together to form the barrier (10).

18 Claims, 1 Drawing Sheet

IMPACT ABSORBING BARRIER AND METHOD OF CONSTRUCTING SAME

TECHNICAL FIELD

This invention relates generally to barriers and methods of constructing barriers and more specifically, to an impact absorbing barrier for use in conjunction with moving vehicles or the like, and a method of constructing same.

BACKGROUND

A tremendous amount of personal injuries and property damage occurs on various roadways and waterways each year. As a result, designers continually search for effective ways to protect both property and vehicle occupants. Various types of barriers have been employed to this end. While many of these barriers are designed to absorb the impact of a collision with a moving vehicle, frequently such barriers are completely destroyed as a result of the collision and must be replaced. Moreover, motor vehicles, especially those used in automobile racing, have an ever increasing ability to travel at high speeds. As a result, many barriers are no longer capable of protecting property or vehicle occupants during a high speed collision.

An ideal barrier for use in conjunction with moving vehicles or the like would not only be impact absorbing, but would also be able to withstand the impact of a high speed collision associated with automotive racing accidents. Additionally, an ideal impact absorbing barrier would be able to withstand a number of collisions before requiring replacement.

SUMMARY OF THE INVENTION

An object of the present invention is to provide an impact absorbing barrier for use in conjunction with moving vehicles or the like to prevent property damage and personal injury during collisions.

Another object of this invention is to provide an impact absorbing barrier that is able to withstand repeated collisions before requiring replacement.

A further object of this invention is to provide an impact absorbing barrier that is simple in design and durable in construction.

Yet another object of this invention is to provide a method of constructing an impact absorbing barrier for use in conjunction with moving vehicles or the like that provides a barrier of adequate density capable of protecting property and vehicle occupants during collisions.

Still another object of this invention is to provide a method of constructing an impact absorbing barrier that produces a barrier of adequate density to withstand repeated collisions before requiring replacement.

Another other of this invention is to provide a method of constructing an impact absorbing barrier that is quickly and easily constructed utilizing well known materials.

A still further object of the present invention is to provide an impact absorbing barrier for use in conjunction with moving vehicles that is of simple construction and makes use of used tires for economy of construction.

In carrying out the above objects and other objects of the invention, the impact absorbing barrier includes a plurality of torroid-like bumpers. Each bumper comprises a plurality of tire halves. The tire halves are formed by separating a plurality of complete tires of various diameters circumferentially along their tread paths. A portion of the plurality of tire halves of various diameters form a nest of tire halves. A matching pair of the plurality of tire halves having a diameter greater than the nested tire halves form an envelope around the nested tire halves. The bumpers are stacked vertically to form a cylinder and the cylinder is compressed along its longitudinal axis. A plurality of bands longitudinally encircle the wall of the cylinder to permanently bind the bumpers together.

The impact absorbing barrier of the present invention is constructed by the method of separating a plurality of complete tires of various diameters circumferentially along their tread paths into tire halves. The method also includes placing a first tire half on a base with its concave side exposed, nesting a plurality of tire halves having diameters less than the diameter of the first tire half on the exposed concave side of the first tire half, and placing a second tire half having a diameter similar to the diameter of the first tire half on top of the nested tire halves to envelope the nested tire halves between the concave sides of the first and second tire halves. Completion of the foregoing steps forms a torroid-like bumper. The method of making an impact absorbing barrier concludes by repeating the steps necessary to form the bumper, stacking the bumpers vertically to form a cylinder, and tying the bumpers of the cylinder together to form a barrier.

The above objects and other objects, features and advantages of the present invention are readily apparent from the following detailed description of the best mode for carrying out the invention when taken in connection with the accompanying drawings.

DETAILED DESCRIPTION OF THE DRAWINGS

Figure 1:
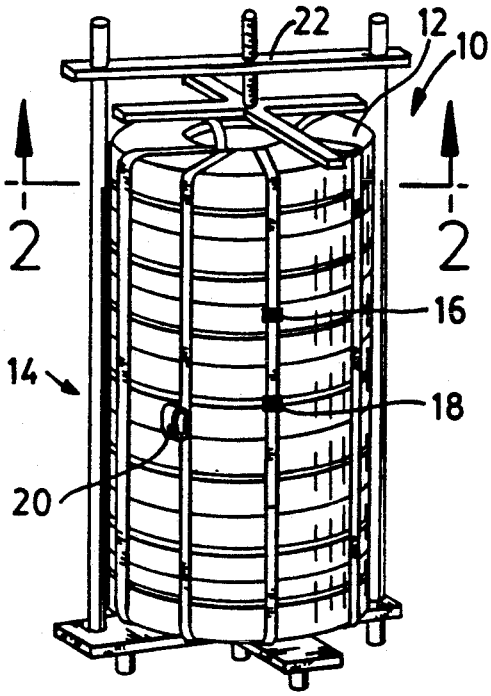
FIG. 1 is a perspective view of an impact absorbing barrier constructed in accordance with the present invention illustrated on a screw compression press, shown in phantom, on which the barrier is constructed.

Referring now to FIG. 1, an impact absorbing barrier constructed in accordance with the present invention is generally indicated by reference numeral 10 and is used in conjunction with moving vehicles or the like to prevent property damage and personal injury. As is hereinafter more fully described, the barrier 10 utilizes used tires and is simple in design and durable in construction.

As shown in FIG. 1, the impact absorbing barrier 10 includes a plurality of torroid-like bumpers 12. The bumpers 12 are stacked vertically to form a cylinder 14. The bumpers 12 of the cylinder 14 are permanently bound by a plurality of bands 16. The bands 16 encircle the wall of the cylinder 14 longitudinally. The bands 16 are preferably spaced apart equally from each other around the circumference of the cylinder 14.

In the preferred embodiment, at least four bands 16 are used, spaced apart by 90°. The bands 16 are preferably formed from galvanized steel and crimped with locking clips 18. The bands 16 may be double crimped with locking clips 18 for added strength. At least one coupling bracket 20 is attached to one of the bands 16. The coupling bracket 20 allows multiple barriers to be attached in a chain-like manner to form a guardrail and is preferably formed of cold-rolled flat steel for increased strength. FIG. 1 also shows a screw compression press 22 on which the barrier 10 is constructed, as hereinafter described, and on which the barrier 10 is compressed by compressing the cylinder 14 along its longitudinal axis.

Figure 2:
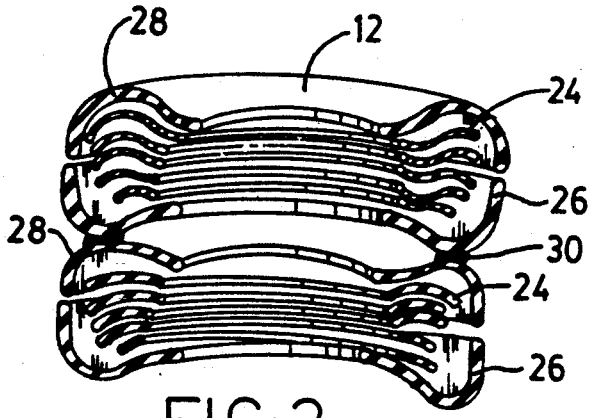
FIG. 2 is a partial cross-sectional view of the impact absorbing barrier of the present invention taken along line 2—2 in FIG. 1.

Referring now to FIG. 2, a pair of the bumpers 12 making up the barrier 10 are shown in cross-section. The bumpers 12 comprise a plurality of tire halves 24 nested within an envelope formed by a first tire half 26 and a second tire half 28. The nested tire halves 24 are separated circumferentially from a plurality of complete tires of various diameters along their tread paths. The first tire half 26 and the second tire half 28 are separated circumferentially from a plurality of complete tires having a diameter substantially similar to each other and greater than the various diameters of the nested tire halves 24. The bumpers 12 are bonded by an adhesive 30 applied between neighboring bumpers 12. The adhesive 30 is preferably rubber based and is applied between the convex sides of the second tire half 28 and the first tire half 26 of consecutive bumpers 12.

Figure 3:
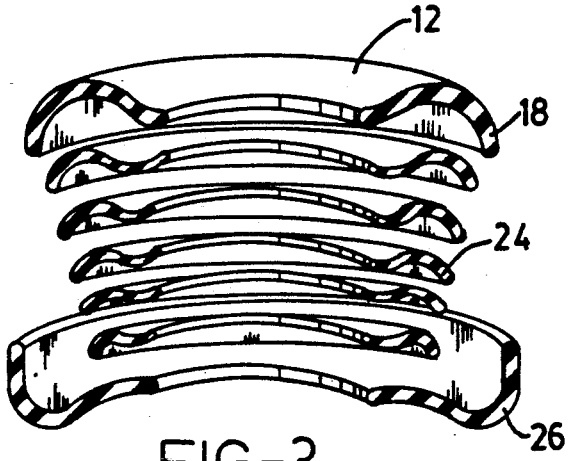
FIG. 3 is an exploded cross-sectional view of one torroid-like bumper which makes up the impact absorbing barrier of the present invention.

Referring now to FIG. 3, one bumper 12 is shown in an exploded cross-sectional view. The first tire half 26 and the second tire half 28 are preferably formed from a P235R-15, or similarly large, tire separated circumferentially along its tread path. The nested tire halves 24 are preferably formed from tires designated P155R-13, P165R-13, P175R-13, P185R-13, P185R-14, P195R-14, P205R-14, P205R-15, P215R-15, and P225R-15, or similarly designated tires of lesser diameter, separated circumferentially along their tread paths. For maximum density, the nested tire halves 24 are stacked by increasing diameter so that the convex side of each nested tire half 24 mates with the concave side of the immediately neighboring nesting tire half 24. The relative density of the bumpers 12 can be varied by utilizing alternate configurations for the nested tire halves 24. The increased density of the bumpers 12 helps protect property and motor vehicle occupants during a high speed collision and allows the barrier 10 to sustain multiple collisions before replacement is required.

Figure 4:
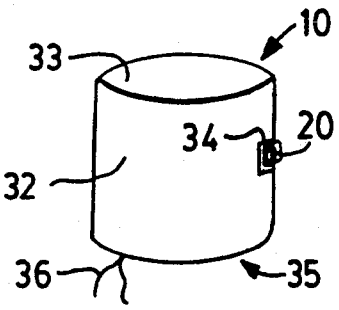
FIG. 4 is a perspective view of the impact absorbing barrier of the present invention with slip covering mounted thereon.

Referring now to FIG. 4, the barrier 10 of the present invention is shown with a protective slip-cover 32. The slip-cover 32 is cylindrical in shape having a closed end #33 and an open end #35. The open end 35 of the slip-cover 32 fits over the impact absorbing barrier 10 so that the barrier 10 is covered in a glove-like fashion. The slip-cover 32 is preferably formed from weather resistant and flame retardant materials, such as polyethylene, and has at least one opening 34 to allow the coupling bracket 20 to be exposed for the purpose of coupling multiple barriers 10 together to form a guardrail. The slip-cover 32 also has a draw string 36 to ensure a tight fit around the barrier 10 and help prevent exposure to the elements.

Figure 5:
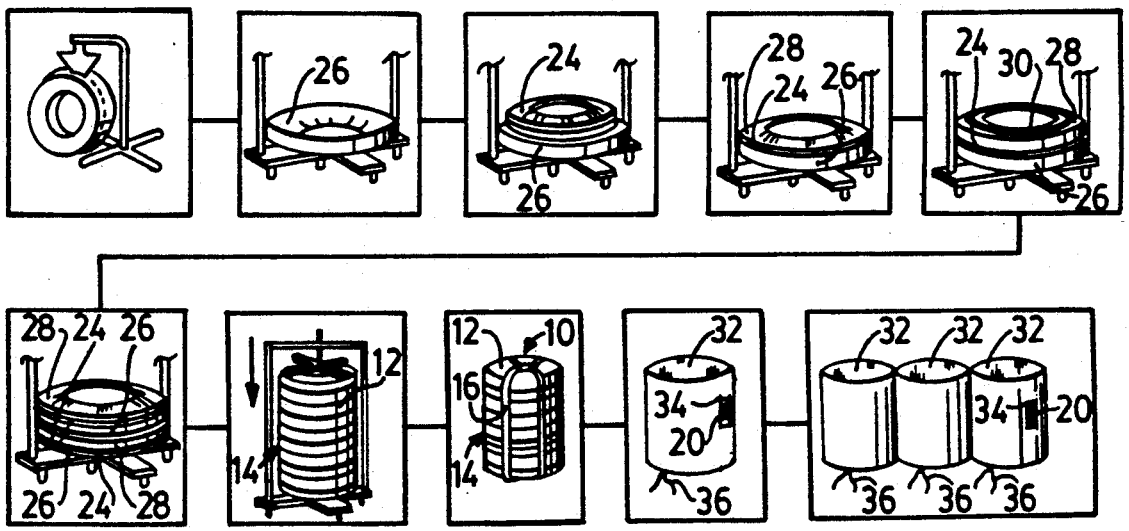
FIG. 5 is a block diagram view of a method of manufacturing an impact absorbing barrier in accordance with the present invention.

Referring now to FIG. 5, a block diagram of the method of constructing the impact absorbing barrier 10 of the present invention is shown. The first method step for manufacturing the barrier 10 is separating a plurality of tires having various diameters circumferentially along their tread paths to form tire halves 24, 26, 28. Each resulting tire half 24, 26, 28 has a convex side and a concave side. The tire halves 24, 26, 28 are preferably formed by cutting a complete tire circumferentially along its tread path, but can be formed by any known means for separation.

Subsequent method steps include placing a first tire half 26 on a base with its concave side exposed, nesting a plurality of tires halves 24 having diameters less than the diameter of the first tire half 26 on the exposed concave side of the first tire half 26, and placing a second tire half 28 of a diameter similar to the diameter of the first tire half 26 to envelope the nested tire halves between the concave sides of the first and second tire halves 26, 28. For maximum density, the tire halves 24 are preferably nested by increasing diameter so that the convex side of each nested tire half 24 mates with the concave side of the immediately neighboring nested tire half 24.

Relative density of the bumpers 12 can be varied by utilizing alternate configurations for nesting the tire halves 24. The method for manufacturing a barrier concludes by repeating the steps necessary to form a torroid-like bumper 12, stacking the bumpers 12 vertically to form a cylinder 14, and tying the bumpers 12 together to form a barrier 10.

The method of constructing a barrier 10 may also include bonding each bumper 12 to the immediately preceding bumper 12. The bonding step includes applying a rubber based adhesive between neighboring torroid-like bumpers 12.

The method of constructing a barrier 10 may further include compressing the cylinder 14 after stacking the bumpers 12 and before tying the bumpers 12 to form a barrier 10. The compressing step increases the density of the resulting barrier 10. This increased density helps protect property and motor vehicle occupants during a high speed collision and allows the barrier 10 to sustain multiple collisions before replacement is required.

The method of constructing a barrier 10 may also include covering the barrier 10 with a protective cover 32. The covering step includes fitting a slip-cover 32 formed from weather resistant and flame retardant materials over the barrier 10 in the glove-like fashion.

Finally, the method of constructing a barrier 10 may also include coupling a plurality of barriers 10 together to form a guardrail. The coupling step includes attaching a steel coupling bracket 20 to each barrier 10 so that multiple barriers 10 may be coupled in a chain-like manner to produce the guardrail.

While the best mode for carrying out the invention has been described in detail, those familiar with the art to which this invention relates will recognize various alternative designs and embodiments for practicing the invention as defined by the following claims.

What is claimed is:

1. A method of constructing an impact absorbing barrier for use in conjunction with moving vehicles, the method comprising the steps of:

separating a plurality of complete tires of various diameters circumferentially along their tread paths into tire halves, each tire half having a concave side and a convex side;

placing a first tire half on a base with its concave side exposed;

nesting a plurality of tire halves separated from tires of a diameter less than the diameter of the first tire half on the exposed concave side of the first tire half;

placing a second tire half separated from tires of a diameter substantially like the diameter of the first tire half with its concave side facing the nested tire halves to envelope the nested tire halves to form a torroid-like bumper;

repeating at least once the steps of placing a first tire half, nesting a plurality of tires and placing a second tire half;

stacking the bumpers vertically to form a cylindrical stack; and tying the bumpers of the cylindrical stack together to form a barrier.

2. The method of claim 1 further comprising the step of, between the repeating and stacking steps, bonding each bumper to the immediately preceding bumper.

3. The method of claim 2 wherein the bonding step includes applying a rubber based adhesive between neighboring bumpers.

4. The method of claim 1 further comprising the step of, between the stacking and tying steps, compressing the cylindrical stack longitudinally.

5. The method of claim 1 further comprising the step of covering the barrier with a protective cover.

6. The method of claim 5 wherein the covering step includes fitting a slip-cover formed from weather resistant and flame retardant materials over the barrier in a glove-like fashion.

7. The method of claim 1 further comprising the step of coupling a plurality of barrier together to form a guardrail.

8. The method of claim 7 wherein the coupling step includes attaching a steel coupling bracket to each barrier.

9. The method of claim 1 wherein the tying step includes applying a plurality of galvanized steel bands longitudinally around the wall of the cylindrical stack, the bands being equally spaced from each other about the circumference of the stack.

10. An impact absorbing barrier for use in conjunction with moving vehicles, the barrier comprising:

a plurality of torroid-like bumpers stacked vertically and compressed longitudinally to form a cylinder, each bumper comprising a plurality of tire halves separated circumferentially from a plurality of complete tires of various diameters along their tread paths, the plurality of tire halves forming a nest of tire halves of various diameters and a matching pair of the plurality of tire halves having a diameter greater than the nested tire halves forming an envelope around the nested tire halves.

11. The barrier of claim 10 further comprising an adhesive applied between each bumper.

12. The barrier of claim 11 wherein the plurality of bumpers vertically stacked and longitudinally compressed is five bumpers compressed to a cylinder having a height of approximately 48 inches and a diameter of approximately 32 inches.

13. The barrier of claim 11 wherein the adhesive is rubber based.

14. The barrier of claim 10 further comprising means for coupling a plurality of cylinders formed by the stacked bumpers.

15. The barrier of claim 14 wherein the means for coupling is at least one coupling bracket formed from steel attached to one of the bands.

16. The barrier of claim 10 further comprising a cylindrical cover having an open end and a closed end, wherein the open end of the cover is placed over the cylinder formed by the stacked bumpers in a glove-like fashion.

17. The barrier of claim 16 wherein the cover is formed from a weather resistant and flame retardant material.

18. The barrier of claim 10 wherein the bands are formed of steel and are equally spaced from each other about the circumference of the cylinder formed by the stacked bumpers.

* * * * *